United States Patent [19]

Landwehrkamp et al.

[11] 3,945,183

[45] Mar. 23, 1976

[54] METHOD AND APPARATUS FOR STARTING A THREAD IN OPEN-END SPINNING DEVICES

[75] Inventors: Hans Landwehrkamp, Lenting; Heinz Niestroj, Ingolstadt, both of Germany

[73] Assignee: Schubert & Salzer Maschinenfabrik Aktiengesellschaft, Ingolstadt, Germany

[22] Filed: Oct. 7, 1974

[21] Appl. No.: 513,034

[30] Foreign Application Priority Data

Oct. 13, 1973 Germany ..... 2351458

[52] U.S. Cl. ..... 57/34 R; 57/58.89; 57/81

[51] Int. Cl.[2] ..... D01H 13/16; D01H 15/00

[58] Field of Search ..... 57/34 R, 58.89–58.95, 57/156, 81, 78

[56] References Cited

UNITED STATES PATENTS

| | | | |
|---|---|---|---|
| 3,354,626 | 11/1967 | Cizek et al. | 57/58.89 X |
| 3,455,095 | 7/1969 | Makeham et al. | 57/34 R |
| 3,541,774 | 11/1970 | Sterba et al. | 57/58.89 X |
| 3,680,300 | 8/1972 | Landwehrkamp | 57/34 R |
| 3,733,799 | 5/1973 | Roethke | 57/34 R |
| 3,749,327 | 7/1973 | Roethke et al. | 57/34 R X |
| 3,780,513 | 12/1973 | Watanabe et al. | 57/34 R |
| 3,782,089 | 1/1974 | Landwehrkamp et al. | 57/34 R |
| 3,791,128 | 2/1974 | Landwehrkamp et al. | 57/58.89 X |
| 3,803,823 | 4/1974 | Niestroj et al. | 57/34 R |

*Primary Examiner*—Donald E. Watkins
*Attorney, Agent, or Firm*—Robert W. Beach; R. M. Van Winkle

[57] ABSTRACT

When spinning is to be started or restarted after interruption, an operator places a combination spool support and electronic pack on tracks at the spinning station, locates the pack in spool-supporting position, electrically connects the pack with a spinning station connection, draws a predetermined length of thread from the takeup spool, inserts it into the drawoff tube, and actuates a switch on the pack. The pack contains an electronic timing circuit, which sequentially effects starting of the fiber supply to the spinning chamber, and, after a predetermined time delay, effects reengagement of the thread takeup spool with its drive roller.

12 Claims, 6 Drawing Figures

14
15
16
46
50
42
56
59
12
13
40
17
5
77
19
62
4
18
11
41
84'
84
8
64
83
82
9
10
3
30
80
24
21
26
1
1'
22
25
23
2
20

METHOD AND APPARATUS FOR STARTING A THREAD IN OPEN-END SPINNING DEVICES

The present invention relates to a method for starting a thread in an open-end spinning device, and to apparatus for performing such method.

In accordance with known procedure, when a thread breaks or tension in the spun thread is relaxed, a yarn reserve mechanism located between the drawoff rollers and the winding spool is actuated by a thread tension detector to free the yarn from the nip of the drawoff rollers and to drop a reserve stretch of thread into the open-end spinning device, as disclosed in U.S. Pat. No. 3,680,300. Such reserve devices are expensive, and a device must be supplied for each spinning station of a spinning machine.

Other devices for engaging thread on a winding spool and guiding such thread back into the spinning chamber are disclosed in U.S. Pat. No. 3,810,352 and U.S. Pat. No. 3,695,017. Such devices are completely automatic and may be supplied for each spinning station, but they have the same high cost effect as the reserve device described above. More commonly, one of such automatic devices is mounted on a carriage for travelling along a track to service a plurality of spinning stations. Even though cost is somewhat reduced thereby, such automatic devices are limited in usefulness by the fact that shutdown of a station usually indicates the need for servicing by an operator before spinning can be restarted. Consequently, the value of the automatic device is substantially nullified.

Another arrangement, disclosed in U.S. Pat. No. 3,782,089, includes a switching unit located to cooperate with the spool-holder for manual actuation after a spinning station shutdown. However, the coordination and timing of activating the switch returning a thread stretch to the spinning chamber and lowering of the spool-holder are all performed manually, and the success or lack of success of the starting procedure depends on the particular experience and ability of the operator. The higher the working speeds for the spinning machine, the greater must be the skill of the operator to effect successful startup.

It is the principal object of the present invention to provide a procedure and facilitating apparatus which assures reliable startup of the spinning process in all instances of shutdown by a thread-tension detector.

An additional object is to provide reliability independently of the skill and experience of the operator.

Another important object is to provide such startup method and apparatus which reduces cost substantially below the cost of prior devices and methods for spinning startup.

A further object is to provide automatic startup mechanism which is simple in construction and, therefore, less subject to breakdown.

The foregoing objects can be accomplished by having the operations of locating the thread end and returning it to the spinning chamber performed manually upon completion of station servicing. Thereupon, manual operation of a switch initiates automatic control of fiber feed and subsequent engagement of the thread takeup spool with its drive. In this manner, startup can be performed by an unskilled helper.

The automatic control apparatus of the present invention may be a portable pack including a thread-release element, a takeup spool-supporting element and mechanical mechanism for actuating the thread-release element and retracting the spool-supporting element, which mechanism is operable by a pack-contained solenoid. The pack further carries a trigger for switching a pack-contained electronic circuit, including time-delay circuits for energizing the solenoid. The pack further carries a plug receivable in a receptable on the spinning station to connect the pack circuit with the circuit for an electromagnetically-operable sliver clamp. When the trigger is pulled to switch on the pack circuit, such circuit is effective sequentially to release the sliver clamp and, after a predetermined time delay permitting adequate fiber from the sliver to be supplied to the spinning chamber to resume spinning, to retract the spool-supporting element and actuate the thread-release element, whereby the thread end is dropped into the spinning chamber to unite with the fiber and the takeup spool is engaged with its drive roller to wind the thread being spun. The pack includes spring clips for attaching it to rails on the spinning machine, which locate and support the pack in position to perform its spool-supporting and thread-reserve-holding function. The pack plug is preferably rigidly supported by the pack so that, as the pack is attached to the rail, the plug will automatically connect with its receptacle, eliminating an additional hand operation.

While a separate electromagnetic connection could be provided for the thread-release element, it is preferred that the spool-supporting element have a camming surface engageable with a cam on the thread-release element so that retracting movement of the spool support simultaneously actuates the thread release. To prevent startup at the wrong time through accidental brief actuation of the pack trigger switch, a safety device is interposed between the switch and the sequential startup circuit. While such safety device could be mechanical, it is preferably an additional time-delay electronic circuit. It is preferred that one or both of the time-delay circuits be adjustable, and thus it is most advantageous that they be electronic circuits, and preferably include an adjustable RC (resistance-capacitance) coupling.

The startup pack is sufficiently lightweight and compact so that the operator or a helper can carry it in a pocket making it always available and ready for use on any one of a number of spinning stations. The operator or helper draws a definite length of thread from the spool in normal fashion, drops the end in the drawoff tube of the spinning chamber, guides the thread stretch around the thread-release member on the pack and pulls the trigger to actuate the electronic circuit. Thereafter, release of the sliver, release of the thread reserve and lowering of the takeup spool onto its drive roller are effected in temporally precisely determined sequence, so that starting mistakes by the service person are excluded.

Figure 1:
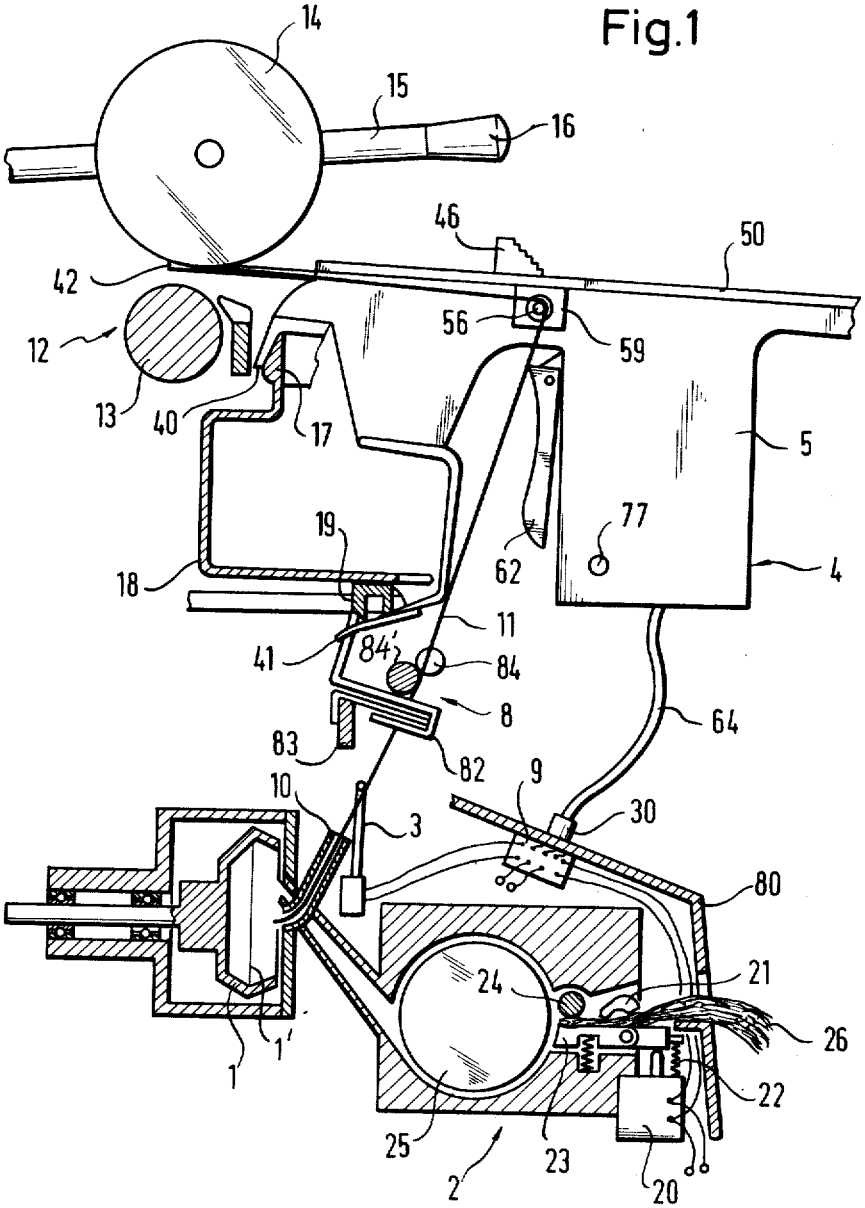
FIG. 1 is a vertical section through a spinning station showing the thread-starting device of the present invention in side elevation.

Although the present invention is illustrated in connection with an open-end spinning machine working in a subatmospheric pressure chamber, it can be used with various types of spinning devices, such as the spinning turbine disclosed in U.S. Pat. No. 3,440,812,which could have a rotatable spinning funnel, as shown in Czechoslovakian Pat. No. 87947, or a stationary funnel, as shown in Japanese published application No. 24051/63. The invention is further usable with an electrostatically-operable spinning element, as shown in British Pat. No. 1,133,710, or a spinning chamber in which the fibers are carried in a fluid medium to a freely-rotating thread end, as disclosed in U.S. Pat. No. 2,911,783.

The spinning device with which the present invention is illustrated includes a spinning turbine 1, to which fibers are fed with a fiber-supply device, which has sliver-resolving mechanism. Spun thread 11 is drawn off through tube 10 by a pair of drawoff rollers 8. A winding device to form a spool 14 includes a winding drive roller 13 frictionally engageable with the spool surface, and the spool is held between a pair of spool-supporting arms 15, at least one of which has a handle 16 for swinging the spool away from roller 13 while exchanging an empty spool core for a full spool.

Adjacent to the outlet end of the drawoff tube is a thread tension detector 3 which is connected to an electromagnet 20 of the fiber-supply device 2. During spinning, a sliver 26 is fed conventionally to a resolving roller 25 by supply roller 24 cooperating with a resiliently-mounted pressure member 23. When the tension in thread 11 drops below a predetermined level, such as when a thread break occurs, detector 3 energizes electromagnet 20, by which its plunger moves an arm of bell crank clamping member 21, whereby sliver 26 is clamped between the other bell crank arm and pressure member 23. The clamping arm of member 21 also presses member 23 away from roller 24 to release feeding pressure on the sliver. Thus, resolving of the sliver is interrupted.

In conventional apparatus, electromagnet 20 would be deenergized when normal spinning tension is again achieved in yarn 11 to change the detector 3 from its electromagnet-actuating condition or when a service person manually switches off current to electromagnet 20. Upon such deenergization, sliver feed to resolving roller 25 resumes, resolved fiber is fed to the collecting trough 1' of spinning turbine 1 and fiber is spun onto the end of a stretch of thread 11 extending through drawoff tube 10 into the spinning chamber. Consequently, it is necessary for the fiber feed to resume before drawoff rollers 8 and spool-winding roller 13 becomes effective to draw thread 11 so that the thread end is not pulled out of the spinning chamber until sufficient fiber is supplied to be picked up by the end of thread 11. If the thread is pulled out too soon, another thread break occurs and the startup procedure must be repeated. If the thread drawoff is delayed too long, the thread will pick up too much fiber at the startup thread end and a low-quality non-uniform thread results.

When a thread break occurs, the end of the thread will have been drawn out of the spinning chamber 1 and drawoff tube 10 and must be returned to the spinning turbine 1 in a position so that its free end is located at the fiber-collecting trough. It is to assure accurate return and location of the thread end for which the apparatus of the present invention serves. A portable pack 4 can be located at the spinning station where startup is required by snapping its resilient hook 40 over upper track 17 and its spring leaf 41 under lower track 19. Tracks 17 and 19 are mounted on a cover member 18 carried by the spinning machine.

Figure 2:
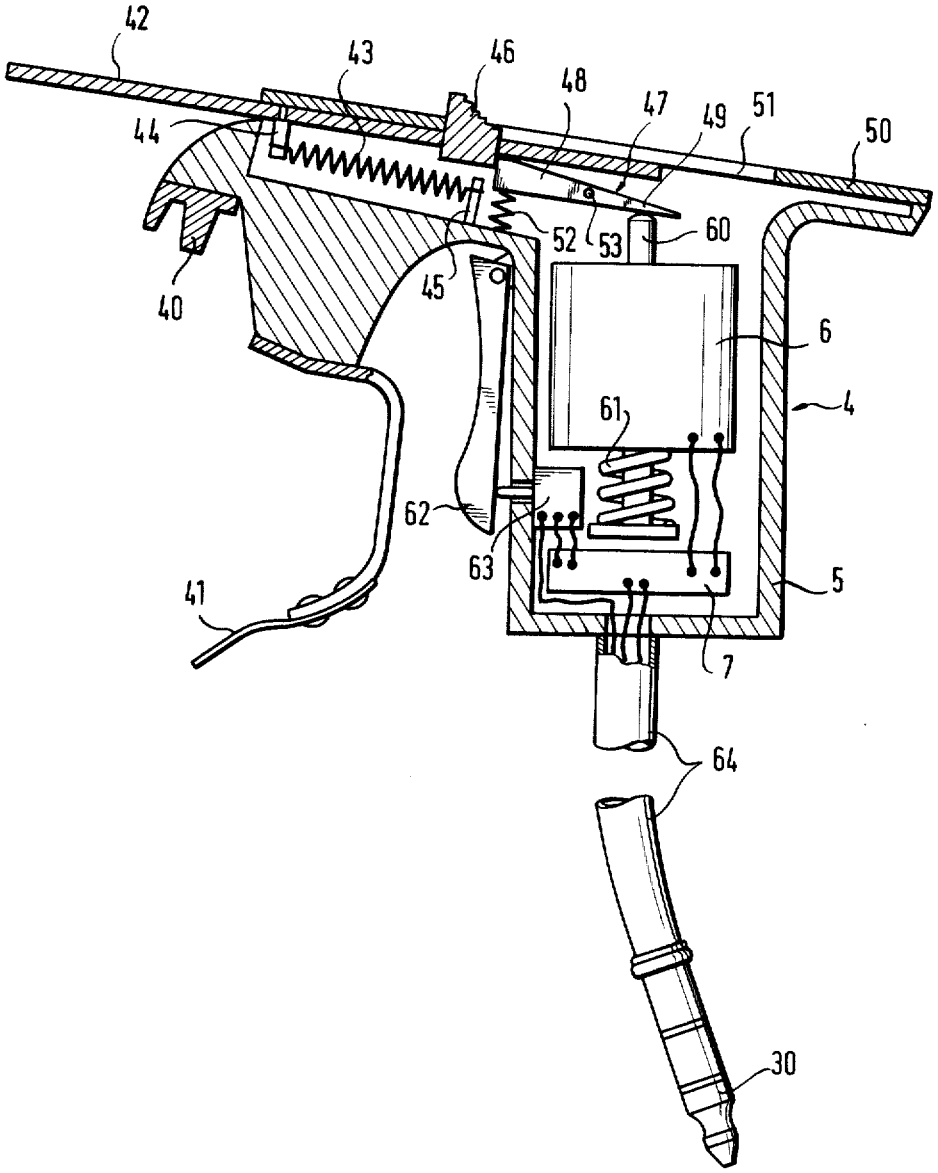
FIG. 2 is a vertical section through the thread-starting device of the present invention.

As shown in FIGS. 1 and 2, pack 4 includes a housing 5 for an electronic circuit as described below, which housing is closed by a cover 50. A cantilever spool-supporting element 42 is slidably mounted in pack 4 for projection and retraction between a projected position to underlie and support winding spool 14, as shown in FIG. 1, and a retracted position for releasing the spool whereby the spool drops into engagement with its drive roller 13. Spool holder 42 is retracted and held in normally-retracted position by tension spring 43 connected between pin 44 on slide 42 and pin 45 carried on a stationary portion of pack 4. A block 46 inserted in slide 42 has a portion projecting through a slot 51 in the cover 50. When the slide is in retracted position (not shown), such block projection can be engaged by the operator's thumb to move it manually from the right, as seen in FIG. 2, to the left end of slot 51 to project the spool-supporting slide 42.

The block 46 also projects from the opposite side of slide 42 and is engageable by a latching lever 47 pivotable about a pin 53. As shown in FIG. 2, the end of one arm 48 of lever 47 engages the block 46 to latch the slide 42 in its projected spool-supporting position. Such lever arm is biased into latching position by compression spring 52. The other lever arm 49 is engaged by armature 60 of electromagnet 6. Upon energization of the electromagnet, armature 60 is extended to swing lever arm 49 upward to disengage arm 48 from latching position, so that spring 43 will be effective to retract spool-supporting slide 42. When electromagnet 6 is again deenergized, spring 52 returns lever arm 48 to its latching position. The upper surface of lever 47 is inclined to form a ramp along which block 46 can slide from its retracting position toward projecting position. As block 46 is slid to the left, it will press arm 48 downward in opposition to the force of spring 52 sufficiently to enable the block to move past the lever end, whereupon the spring will snap the lever into latching position behind block 46.

Figure 6:
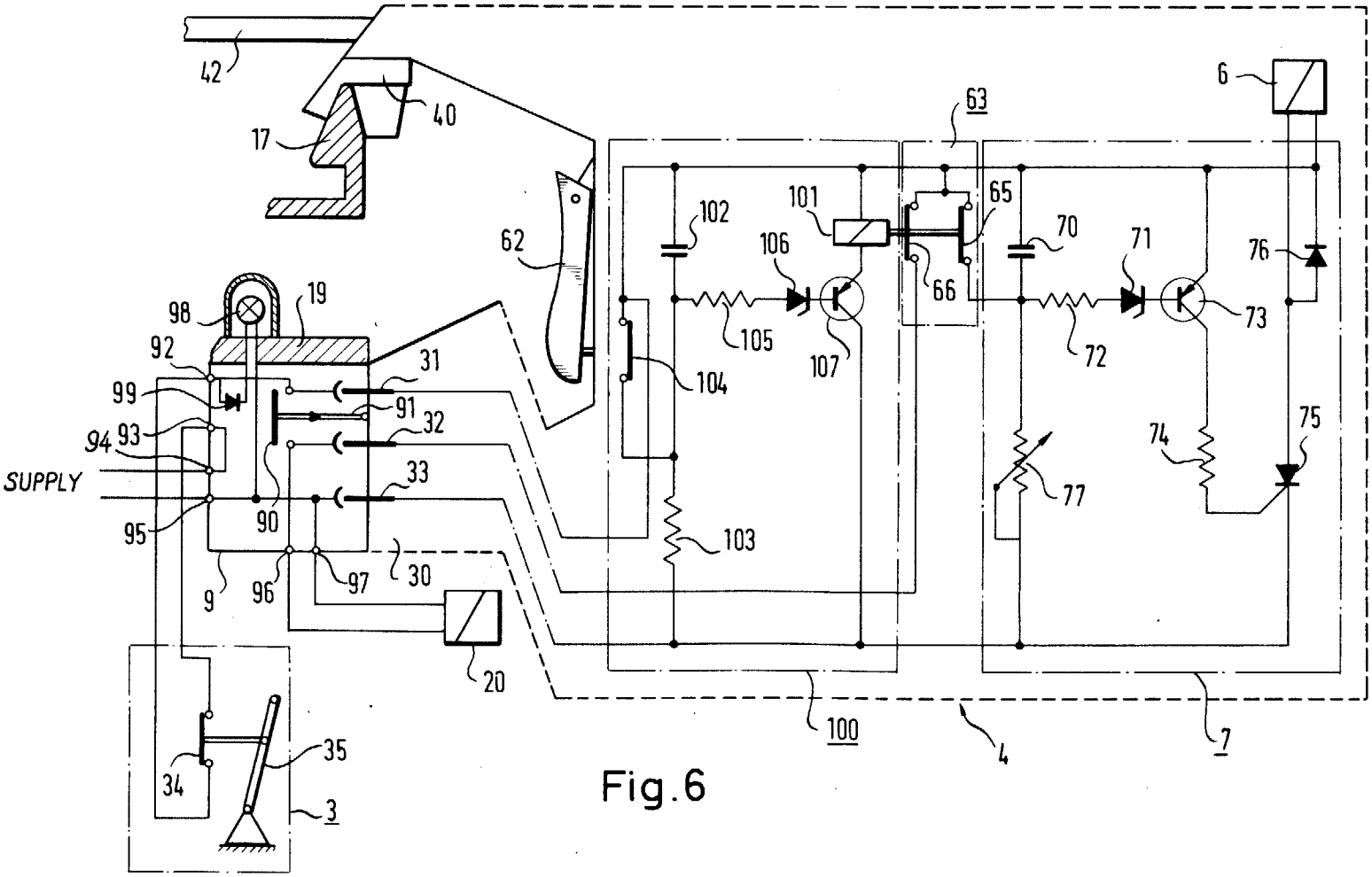
FIG. 6 is a schematic representation of the thread-starting device and electrically cooperative components of the spinning station in connection with a representative circuit diagram for the thread-starting device.

A lever or trigger 62 externally carried on housing 5 can actuate the switch 63, which is connected in the circuit of electromagnet 20 of fiber-supply device 2 through jack 30, shown in FIGS. 1, 2 and 6, and is also connected with a time-delay device 7 (FIG. 6) controlling electromagnet 6 of the spool-holder latching mechanism. The power supply to the pack 4 is provided by the spinning machine through jack 30 when the pack is in operating position at a spinning station.

Figure 3:
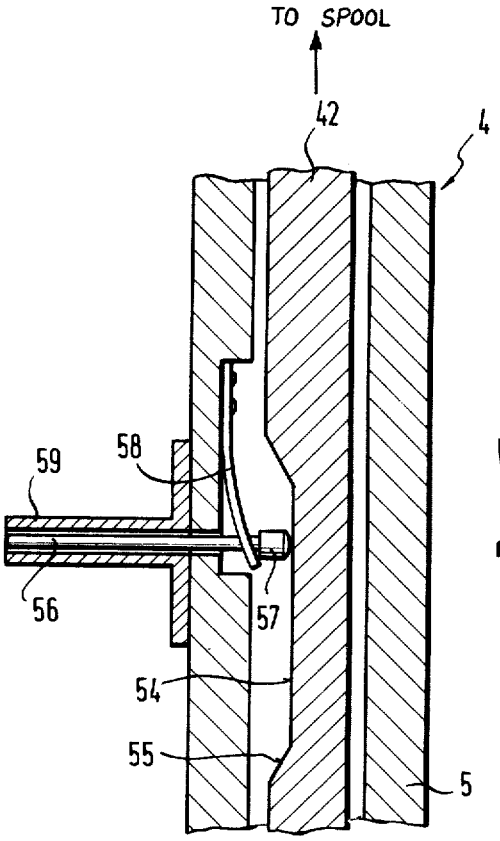
FIG. 3 is a section through a detail of the thread-starting device.
Figure 4:
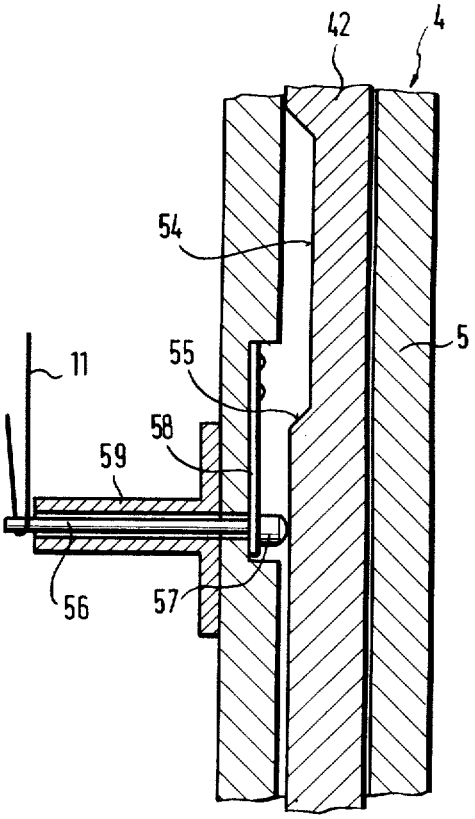
FIG. 4 is a similar view showing parts in different positions.

FIGS. 3 and 4 are cross-sectional views through a portion of housing 5 and spool-holder slide 42 showing a thread-catching member 56 and mechanism for effecting release of the thread on the catching member. Member 56 is projectible beyond the end of a guide sleeve 59 carried by housing 5. In such projected position shown in FIG. 4, a stretch of thread 11 can be looped around the projected end of pin 56 for purposes described hereinafter. Pin 56 has an enlarged head 57 which forms a cam follower biased by a flat spring 58 into engagement with an edge of spool-holding slide 42. Such slide edge forms a cam surface including an offset trip cam surface 54 and a ramp 55 connecting the slide edge and the offset surface 54.

Figure 5:
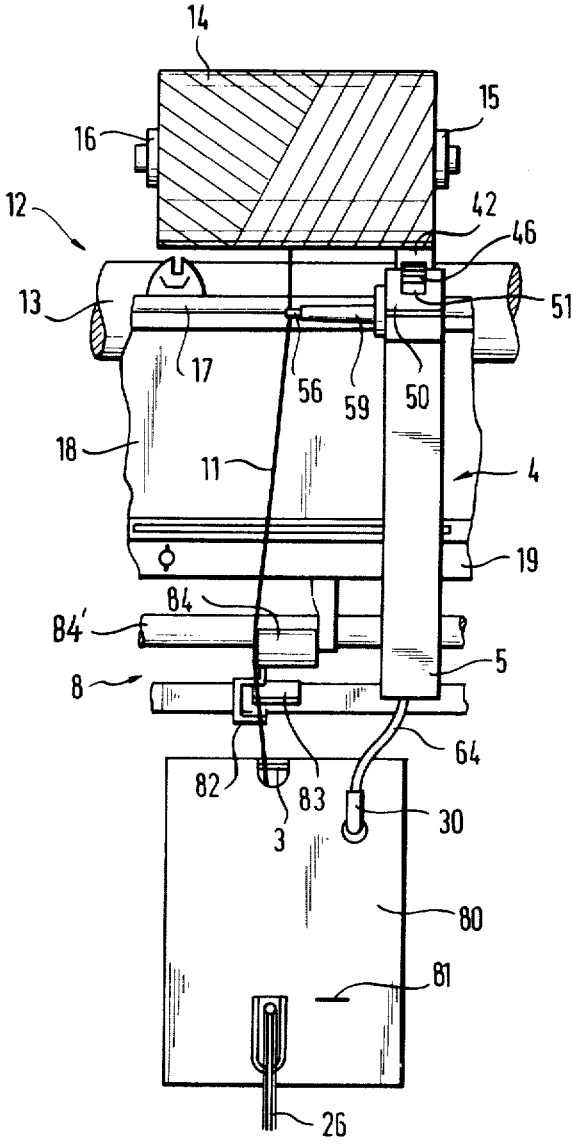
FIG. 5 is a front elevation of a spinning station and the thread-starting device, parts being broken away.

The components of pack 4 described above operate as follows. To start the thread after a thread break, or after an interruption in spinning for servicing the spinning machine, for example, spool 14 is lifted. Spool holders 15 hold the spool in the raised position by conventional latching mechanism. The pack 4 is located at the spinning station to be started by hooking hook 40 over track 17 and swinging the pack downward about track 17 as a center until spring 41 engages track 19 and snaps into pack-latching position. Pack 4 is positioned close to one end of the spool 14, as shown in FIG. 5, so that slide 42 can be projected beneath the spool, and thread-catching pin 56 and guide sleeve 59 project in a direction parallel to the spool axis toward the center of spool 14. Locating the pack may be facilitated by a marker or indicator on track 17.

Block 46 is then moved along slot 51 to project cantilever spool-holding slide 42 so that its free end underlies spool 14. As previously described, lever 47 snaps into its latching position, shown in FIG. 2, to maintain slide 42 in its extended position. Simultaneously, cam follower 57, which normally engages cam surface 54, as shown in FIG. 3, rides up ramp 55 and onto the principal edge surface of slide 42, in opposition to spring 58, as the slide moves relative to follower 57 to project the end portion of thread-catching pin 56 opposite its head 57 beyond the guide sleeve 59.

The service person then grasps the free end of the thread wound on spool 14 and unwinds the spool as required to provide an ample stretch of thread to reach to the spinning turbine. Additionally, it is preferred that the thread be withdrawn from the axially central region of the spool. Using handle 16 on a spool holder 15, spool 14 is lowered onto spool-supporting member 42. Gauging the required stretch of thread is facilitated by an indicating mark 81 on cover 80 of the thread-resolving device, as shown in FIG. 5. Thread 11 is then guided over thread-catching pin 56 and the thread end dropped into drawoff tube 10 so that the thread assumes the position of FIG. 1, in which the thread end is spaced from collecting trough 1' and the thread stretch between the drawoff rollers 8 and spool 14 is diverted by pin 56 from a straight line, thereby providing a thread reserve of predetermined length.

After guiding the thread into such position, the service person pulls trigger 62 firmly toward holder 5 to actuate switch 63 shown in FIG. 2. By actuation of switch 63 electromagnet 20 is deenergized to release clamp 21, which is then moved by spring 22 to release sliver 26 and pressure member 23 to resume feed of sliver to the resolving device and thereby resume feed of fiber to the spinning turbine 1. Such fibers are laid in the collecting trough 1' in conventional manner to form a fiber ring.

Switch 63 also actuates timing device 7, so that, after a predetermined delay, electromagnet 6 is energized and its plunger 60 swings latching lever 47 to release block 46. Spring 43 thereupon effects retraction of slide 42 to release spool 14, which drops by gravity onto winding roller 13. Simultaneously, as shown in FIG. 3, cam follower 57 is urged by spring 58 down ramp 55 and onto cam surface 54 to retract pin 56 and thereby release thread 11 held on such pin. The thread is thereby free to be sucked into the spinning chamber 1 by the low pressure therein, where the thread end unites with the fiber ring formed during the delay between deenergization of electromagnet 20 and energization of magnet 6. When the thread tension reaches its normal value by being wound onto spool 14 by drive roller 13, tension detector 3 actuates a switch to cut off the power supply to pack 4. As shown in FIG. 5, during the startup operation thread 11 lies alongside an end of drawoff roller 84, which roller end is offset from a straight line between the axially central portion of spool 14 and the tension detector 3. As thread tension increases, thread 11 tends to assume a straight path, and such tendency causes the thread to migrate into the nip between drawoff roller 84 and its drive roller 84' and to be threaded into thread guides 82 and 83, whereupon the startup process is completed.

The apparatus of the present invention can be altered in many ways. For example, the thread catch member 56, instead of being operated by a cam surface movable with the spool-holding slide 42, could be operated by the plunger of an additional electromagnet actuatable by the timing device 7. The thread catch member need not be carried by the pack, but may be of conventional type, such as disclosed in U.S. Pat. No. 3,680,300, for example.

In order to avoid accidental energization of the pack startup circuit by inadvertent engagement of trigger 62 with switch 63, some form of safety device can be connected between the trigger and the timing circuit. For example, a relatively stiff spring could be connected to trigger 62, the force of which must be overcome in order to actuate switch 63, so that only a positive firm grip on the trigger would actuate the switch. Alternatively, an electronic safety device for switch 63 may be provided to provide a dwell between pulling of trigger 62 and closing of switch 63. In either case, it is desirable that the delay of the timing device 7 be adjustable to compensate for the effect of a safety device.

Among other possible variations is the provision of a thread cutter at the location of indicator 81 (FIG. 5) by which excess thread could be readily cut off to permit the thread 11 to leave the spool more precisely near the axially central portion of the spool 14. The biasing springs 43, 52 and 58 could be replaced by other biasing means, such as pneumatically or hydraulically operable biasing members.

Tracks 17 and 19 could extend past several or all stations of the spinning machine, and the pack could simply be slid along the tracks from station to station. In such construction, power could be supplied to the pack by brushes engageable with a current-carrying track. However, in the construction shown and described above, the pack is snapped under tracks 17 and 19 at a selected spinning station and is connectable through plug or jack 30 with the power supply for the fiber supply device 2 and thread detector 3. While a flexible cable 64 is shown connecting plug 30 with pack 4, the plug could be carried on a rigid bar or rod so that, as the pack is swung into position, the plug will automatically engage in a corresponding receptable of the spinning station. In such case the plug and receptacle connection serves as a locating device to assure that the pack will be precisely positioned relative to spool 14 at the right end of the spool, as viewed in FIG. 5.

FIG. 6 illustrates the pack 4 in its operative position relative to the cooperating portions of a spinning station together with the circuit diagrams for the cooperable electronic members: component 9 shown schematically in FIG. 1, thread detector 3, and the component blocks 63 and 7 shown in FIG. 2. A further component 100 has been added in FIG. 6, which is an additional delay device connected between trigger 62 and switch 63, serving as a safety device requiring the trigger to be held depressed for an appreciable time to prevent accidental actuation of the startup circuits. Each of the components 3, 100, 63 and 7 are enclosed by a box in dot-dash lines.

Plug 30 has three contacts 31, 32 and 33. In series between contacts 31 and 33 are a capacitor 102 and a resistor 103. A switch 104 connected in parallel with capacitor 102 is normally closed, and thereby short circuits the capacitor. When trigger 62 is squeezed, switch 104 opens, shunting current to the capacitor 102 so that it begins to charge. Connected to the circuit portion between resistor 103 and capacitor 102 are, in sequence, a resistor 105, a Zener diode 106, and the base of a transistor 107. A relay 101 is connected between contact 31 and the emitter of transistor 107 while the transistor collector is connected directly to contact 33. Switch 63 is actuated by relay 101 a predetermined time after capacitor 102 has received the threshold charge for actuating the emitter of transistor 107 through resistor 105 and Zener diode 106. If the trigger 62 were inadvertently momentarily squeezed or pushed and then released, switch 104 would return to its normally closed position, which effects discharge of capacitor 102 so that relay 101 fails to actuate switch 63.

When plug 30 is engaged in the spinning machine receptacle 9, the initial circuit to fiber clamp actuating electromagnet 20 is broken in a manner described below, and the electromagnet circuit is maintained through contact 31, normally closed contact 66 of switch 63 and contact 32.

Switch 63 has a second contact 65, which is normally closed to short circuit a parallel capacitor 70. In series with contact 65 and capacitor 70 are a resistor 72, a Zener diode 71, and the base of a transistor 73, the emitter of which is connected to contact 31 of plug 30. The collector of transistor 73 is connected through resistor 74 to the entrance of a thyristor 75. Electromagnet 6 operable to release latch lever 47 for retraction of spool holder 42 is connected directly to contact 31 and is connected to thyristor 75 through contact 33. To ensure reliable quenching of thyristor 75 when current to its entrance is interrupted, a quenching diode 76 is connected in parallel with electromagnet 6 in a conventional manner.

When relay 101 is operated by transistor 107 to open contacts 66 and 65, fiber-clamping electromagnet 20 is immediately deenergized to enable fiber feed to begin. Current is simultaneously supplied to capacitor 70 to charge it to the threshold quantity for activating transistor 73 which in turn conditions thyristor 75 to energize electromagnet 6 a predetermined time after switch 63 is opened. The time delay can be adjusted by providing a variable resistor or potentiometer 77 in series with capacitor 70.

As shown in FIG. 1, a receptable 9 is provided on cover 80 of the resolving device 2 at a suitable location relative to track 19 for reception of plug 30 when the holder is properly positioned relative to spool 14. Receptacle 9 is enclosed by a solid-line box in FIG. 6 and has a switch 90 which is normally closed when no pack plug 30 is engaged in the receptacle. Switch 90 connects the leads for contacts 31 and 32 for the purpose described below. Plug 30 carries a switch actuator 91 which opens switch 90 as the plug is inserted to disconnect the potential short circuit between contacts 31 and 32.

Receptacle 9 has six terminals 92, 93, 94, 95, 96 and 97. In the condition of the spinning machine shown in in FIG. 6, thread detector 3 has closed switch 34, which is open during normal spinning operation. Terminals 94 and 95 are connected to a power supply. Terminal 94 is connected through terminal 93 to one side of switch 34. Terminal 95 is connected through signal light 98 and diode 99 to the other side of switch 34 so that closing of switch 34 actuates the signal 98, indicating the station at which a thread break has occurred. Electromagnet 20 is actuated to effect clamping of sliver when switch 34 is closed by completing a circuit from power supply terminal 94 through terminal 93, switch 34, terminal 92, normally closed switch 90, terminal 96, electromagnet 20, terminal 97 and power supply terminal 95.

In response to signal 98, a service person places the pack in position and connects plug 30 with receptacle 9 whereby actuator 91 opens switch 90. The electromagnet 20 is maintained in energized condition through power supply terminal 94, terminal 93, switch 34, terminal 92, contact 31, contact 66 of switch 63, contact 32, terminal 96, electromagnet 20, terminal 97 and power supply terminal 95 because contact 66 provides a bypass when switch 90 is open. Insertion of plug 30 has no effect on lamp 98, so that it remains illuminated so long as switch 34 is closed.

After lifting spool 14 above the path of slide 42 using handle 16, projecting spool-supporting slide 42 and, simultaneously, projecting thread-catching member 56, measuring the return thread stretch, cutting off an unusable or excess thread end portion, dropping the thread end into drawoff tube 10, redirecting the thread around thread-catching member 56 and dropping the spool onto slide 42, trigger 62 is pressed to open switch 104. The trigger is held at least for a period sufficient to permit capacitor 102 to charge to the switching threshold of Zener diode 106, whereupon transistor 107 is effective to energize relay 101 and open contacts 65 and 66 of switch 63. Opening of contact 66 deenergizes electromagnet 20, so that fiber clamp 21 is released and sliver feed to resolving roller 25 is resumed. However, the indicator lamp remains illuminated and it is preferred that the operator maintain a grip on trigger 62 until the lamp goes out.

Opening of contact 65 diverts current to capacitor 70, which charges at a rate determined by the setting of potentiometer 77. After reaching the switching threshold of the Zener diode 71, current is supplied to the base of transistor 73, whereby the transistor becomes conductive and fires the thyristor 75. Thereupon, electromagnet 6 is energized to swing lever 47 to unlatch block 46 so that spring 43 will effect retraction of slide 42 for release of spool 14 and the thread 11 held on catch 56. Normal thread tension is reestablished thereafter as previously described, so that contact 34 of detector 3 is opened, and lamp 98 goes out. Once switch 34 has opened plug 30 can be removed. As long as switch 34 remains open, electromagnet 20 remains deenergized so that fiber supply is not interrupted. Upon removal of plug 30, switch 90 returns to its closed position so that the spinning station is conditioned again to respond to any subsequent loss of tension in thread 11.

The timing device can be modified by using a rotatable, variable capacitor in the RC-member (resistance-capacitance coupling member) 70, 77. A fixed resistance could be provided in place of potentiometer 77.

Similarly, the fixed resistance RC-member 102, 103 of safety timer 100 could be replaced by a variable resistor or capacitor combination. If desired, the time-delay safety device 100 could be omitted, in which case contacts 65 and 66 of switch 63 would be opened directly by trigger 62.

We claim:

1. Apparatus for automatically actuating components for spinning startup at a spinning station having a spinning chamber, a thread drawoff opening, a thread tension detector, a thread-winding spool engageable with drive means, a sliver feed and fiber-resolving device, electromagnetic means for interrupting sliver feed, and an electric circuit connecting the electromagnetic means and the thread-tension detector in response to loss of tension in the thread, which apparatus comprises a pack for carrying retractable supporting means for holding the winding spool out of engagement with its drive means, means biasing said supporting means into retracted position, means for projecting said supporting means into spool-holding position, means for latching said supporting means in projected position in opposition to said biasing means, electrically-operable latch-releasing means, switch means for actuating said latch-releasing means, and timing means connected between said switch means and said latch-releasing means for delaying actuation of said latch-releasing means a predetermined time after actuation of said switch means.

2. The apparatus defined in claim 1, in which the pack is portable, and pack-locating and supporting track means carried by the spinning station.

3. The apparatus defined in claim 2, and plug means for electrically connecting the pack to a power supply circuit and further connecting the pack in the circuit connecting the thread-tension detector and the sliver-feed-interrupting electromagnetic means.

4. The apparatus defined in claim 3, in which the plug means includes a plug carried by the pack and a receptacle carried by the spinning station, said plug being mounted rigidly from the pack and cooperable with said receptable for locating the pack in a predetermined operative position relative to the pack-supporting track means.

5. The apparatus defined in claim 1, retractable thread-catching means carried by the pack, and means for retracting and projecting said thread-catching means simultaneously with retraction and projection of the spool-supporting means.

6. The apparatus defined in claim 5, in which the means for retracting and projecting the thread-catching means includes a cam follower carried by the thread-catching means and a cam supported on the spool-supporting means.

7. The apparatus defined in claim 1, actuating means for actuating the switch means, and safety means connected between said actuating means and the switch means for preventing accidental actuation of the switch means.

8. The apparatus defined in claim 7, in which the safety means is a second timing means.

9. The apparatus defined in claim 8, in which the second timing means is adjustable to alter the timing.

10. The apparatus defined in claim 1, in which the timing means is adjustable to alter the timing.

11. The apparatus defined in claim 10, in which the timing means is an electronic timing device including an adjustable RC-member.

12. Apparatus for automatically actuating components for spinning startup at a spinning station having a spinning chamber, a thread-winding spool, drive means for said thread-winding spool, means actuatable for connecting said thread-winding spool with the drive means, a sliver feed and fiber-resolving device, means for interrupting sliver feed, means for feeding thread back to the spinning chamber and means for actuating said thread back-feed means, which apparatus comprises a pack for carrying control means for effecting in a predetermined sequence deactuation of the sliver feed interrupting means, actuation of the thread feed-back means and actuation of the connecting means for the thread-winding spool and the drive means.

* * * * *

PO-1050
(5/69)

UNITED STATES PATENT OFFICE
CERTIFICATE OF CORRECTION

Patent No. 3,945,183 Dated March 23, 1976

Inventor(s) Hans Landwehrkamp and Heinz Niestroj

It is certified that error appears in the above-identified patent and that said Letters Patent are hereby corrected as shown below:

Column 9, line 42, change "receptable" to --receptacle--.

Column 10, lines 39 and 40, cancel "feed-back" and insert --back-feed--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*